US006283426B1

(12) United States Patent
Guthrie et al.

(10) Patent No.: US 6,283,426 B1
(45) Date of Patent: Sep. 4, 2001

(54) SPRING-LOADED CAMMING NUT

(76) Inventors: Karl Guthrie; Joseph Schwartz, both of 28 W. Inwood Forest, Wimberley, TX (US) 78676

( * ) Notice: Subject to any disclaimer, the term of this patent is extended or adjusted under 35 U.S.C. 154(b) by 0 days.

(21) Appl. No.: 09/498,825

(22) Filed: Feb. 4, 2000

(51) Int. Cl.[7] ..... A47F 5/08

(52) U.S. Cl. ..... 248/231.9; 248/231.91; 248/231.21; 248/925

(58) Field of Search ..... 248/231.9, 231.21, 248/231.91, 925, 317, 59, 58, 62

(56) References Cited

U.S. PATENT DOCUMENTS

| | | | | |
|---|---|---|---|---|
| 2,878,668 | * | 3/1959 | Starling et al. | 72/105 |
| 3,478,641 | | 11/1969 | Dohmeier . | |
| 3,877,679 | * | 4/1975 | Lowe | 254/135 |
| 3,903,785 | | 9/1975 | Pepper, Jr. . | |
| 3,957,237 | | 5/1976 | Campbell . | |
| 4,069,991 | * | 1/1978 | Saunders et al. | 248/317 |
| 4,082,241 | | 4/1978 | Burkey . | |
| 4,184,657 | | 1/1980 | Jardine . | |
| 4,293,244 | * | 10/1981 | Donan, Jr. | 405/259 |
| 4,422,607 | | 12/1983 | Vallance . | |
| 4,464,076 | | 8/1984 | Leibhard . | |
| 4,572,464 | | 2/1986 | Phillips . | |
| 4,607,992 | | 8/1986 | Mauritz . | |
| 4,611,963 | | 9/1986 | Frohlich . | |
| 4,643,378 | | 2/1987 | Guthrie . | |
| 4,715,568 | | 12/1987 | Best, Jr. . | |
| 4,818,163 | | 4/1989 | Breiter . | |
| 4,834,327 | | 5/1989 | Byrne . | |
| 4,869,342 | | 9/1989 | Borst . | |
| 5,042,888 | | 8/1991 | Shinjo . | |
| 5,253,964 | | 10/1993 | Swemmer . | |
| 5,484,132 | | 1/1996 | George . | |
| 5,498,108 | * | 3/1996 | Frandberg | 405/259.1 |
| 5,743,061 | * | 4/1998 | Rolph | 52/698 |
| 6,092,773 | * | 7/2000 | Guthrie et al. | 248/231.9 |

FOREIGN PATENT DOCUMENTS

| | | | | |
|---|---|---|---|---|
| 2553668 | | 4/1985 | (FR) . | |
| 2153952 | * | 8/1985 | (GB) | 248/925 |
| 2191710 | | 12/1987 | (GB) . | |

OTHER PUBLICATIONS

Harsh Realm Solutions, LLC, Redmond, WA; Rebolts (tm) Removable Expansion Bolts; *Climbing Magazine*, May, 01–Jun. 15, 1997, p. 159.

* cited by examiner

*Primary Examiner*—Ramon O. Ramirez
*Assistant Examiner*—Kimberly Wood
(74) *Attorney, Agent, or Firm*—Audrey A. Millemann; Joseph E. Gerber

(57) ABSTRACT

The spring-loaded camming nut of the invention includes first and second wedge-shaped chock portion. The first chock portion is wedge-shaped and larger than the second. The second chock portion is prism-shaped with a triangular cross-section. Means are provided for moving the first chock portion axially, lateral to the second chock portion. As the smaller second chock portion travels along the larger first chock portion, toward the crack's opening the first chock portion rotates on its horizontal axis, causing a tooth of the second chock portion to move horizontally and upwardly, into the rock.

20 Claims, 8 Drawing Sheets

SPRING-LOADED CAMMING NUT

BACKGROUND OF THE INVENTION

1. Field of the Invention

The present invention relates generally to anchoring apparatus, and more specifically to apparatus able to be selectively engaged with, and disengaged and withdrawn from, a crack in rock.

2. Description of the Related Art

Those who participate in the sport of rock climbing rely on safety ropes to advance the climb, to protect them against falls, and to support and move their climbing gear along with them as they climb. The rope is removably secured to the rock through the use of anchoring apparatus, which may also interact with carabiners, webbing straps, and other apparatus. There are two types of anchoring apparatus: those that are permanently emplaced ("fixed") in the rock and those that are removable.

Fixed anchoring apparatus include pitons and rock bolts. Conventional pitons comprise a rigid spike with a projecting rigid loop; they are simply pounded into a crack in the rock face with a hammer. Rock bolts may be any of a number of types of apparatus which fall into the general class of mechanical mechanisms commonly referred to as "expansion dowels." These are normally adapted to engage a pre-drilled BOREHOLE, and generally comprise a cylindrical, threaded or nonthreaded dowel body, and a distal expansion member adapted to spread radially in response to axial movement of the dowel body. The axial movement may be accomplished by torque as with a wrench, or by axially-directed force as with a hammer.

Pitons have various disadvantages. They project dangerously from the rock face; they rust; and they can break off and leave more dangerous, sharp remnants. Further, pitons are quite heavy when enough are carried to complete a substantial climb; they sometimes cannot be recovered, necessitating costly replacement; and they are unreliable for later climbers who do not know the age of the piton or the care with which it was placed. Yet further, pitons cannot be used in all types of rock or on all locations; some rock faces are highly erodible and some have few cracks or fissures suitable for emplacement.

Rock bolts pose many of the same problems as pitons, although many styles of rock bolt are, theoretically, removable. Still, removal of a rock bolt requires unscrewing, prying, and often a significant amount of energy and one or more extra tools for the operation.

Moreover, over the last 20–25 years or so, the use of fixed anchors has become disfavored. Climbers and the general public have become increasingly aware of the impact of climbers on the environment and, specifically, of the damage done by fixed anchors to the rock (staining, defacing the rock, breaking down the rock, etc.) and the negative visual aesthetic effect of fixed anchors. In fact, in some cases, public lands management officials and others have ordered removal of, or prohibited further placement of, fixed anchors. As a result, there has been a trend toward "clean climbing, " in which removable anchors, rather than fixed ones, are used. Also, because of these developments, fixed anchors may no longer exist on climbing routes where climbers who wished to use them had expected to find them.

Because of the disadvantages of fixed anchors and the trend toward clean climbing, various instantly-emplaceable, removable anchors have been developed. Active and passive chocks are two types of removable anchors. Active chocks have one or more moving parts, while passive chocks have no moving parts. Chocks, which are also commonly called nuts, are used by forcing them into a crack or crevice in the rock.

Passive chocks include tapers (also called wedges), hexes, Tri-cams, and others. The simplest of these are single-piece, wedge-shaped structures of various sizes, with variously-angled faces. All have in common a secure, projecting loop to which a carabiner, rope or webbing strap may be secured. This loop is normally constructed of coated, flexible cable, and normally projects from the narrower or thinner end of the wedge-shaped body of the chock. The chock is used by simply forcing the wedge into a crack and setting it in place by pulling its projecting loop in the direction in which the chock will bear weight. Passive chocks have several drawbacks, however. One is that a great number of different shapes and sizes of chock may be needed for a given climb, thus increasing the weight the climber must carry. Also, these chocks are sometimes difficult to place and may limit the climber's ability to use their hands to simultaneously hold on to the rock and to place the chock. In addition, although theoretically removable, once a chock is set in a crack and has been used to bear weight, it is often very difficult to remove and retrieve for later use. Thus, the loss of chocks during the course of a climb may cause climbers to incur expenses of replacement. Lastly, later climbers rely on such chocks left behind only at great risk, because their age and stability of placement often cannot be discerned. Such abandoned chocks stay in place and degrade, sometimes leaving dangerous, projecting, frayed cable ends. U.S. Pat. No. 4,442,607 issued to Vallance in 1983 shows such a one-piece chock. Others are shown in U.S. Pat. No. 4,082,241 issued to Burkey in 1978, and U.S. Pat. No. 3,957,237 issued to Campbell in 1976.

Active chocks have been developed to remedy some of the problems encountered in the use of passive chocks. Examples of these are shown in U.S. Pat. No. 3,903,785 issued to Pepper, Jr. in 1975; U.S. Pat. No. 4,572,464 issued to Phillips in 1986; and, U.S. Pat. No. 4,715,568 issued to Best in 1987. Active chocks include sliding nuts and spring-loaded camming devices (also known as "Friends"). The sliding nuts generally include wedge-shaped subcomponents which are slidingly engaged with one another in a way which causes their combined effective width to increase as force is applied to a cable loop or lanyard in a direction away from the wedges. The advantage of such devices is that they are able to be used in a wider range of crack sizes than similarly-sized passive chocks, thus offering climbers greater weight-carrying economy. The sliding nuts are also somewhat easier to remove from cracks than passive chocks because the machined, abutting faces of their wedges slide easily over one another, decreasing the chocks' effective width in response to force directed opposite to the direction in which weight is borne. Nevertheless, a fair collection of sizes still needs to be carried and, when stuck, the sliding nuts tend to rust, rot, and fray like any other chock.

U.S. Pat. No. 4,184,657 issued to Jardine in 1980 shows a spring-loaded camming device of the type commonly referred to as a "Friend." Such devices generally include devices having a central support bar or stem and a cross-spindle, with either three or four oppositely-rotating, gear-toothed cams residing on the spindle. Coil springs on the spindle bias the cams outward, and a pull-bar transverse to the stem and connected to the cams with cables is operable to retract the cams inward toward the central support. In use, such a device is inserted into a crack with its cams retracted. When the cams are expanded, they abut opposing walls of the crack with the cross-spindle in an over-center position. Thus, the downward force is used to create a stronger force against the walls of the crack. The major advantage of "Friends" is fast and easy placement. Friends have significant drawbacks, however, as well. They are mechanically complex, placement is critical, they are expensive, and they have a tendency to move around ("walk") in the crack and become irretrievable.

In light of the mechanical drawbacks and the aesthetic and safety problems caused by the above-described devices, a different type of active chock is needed. Most desirable would be an active chock which is less expensive, less likely to become disengaged from the rock, able to be carried in fewer numbers and sizes, easily retrievable after emplacement, more likely to stay put once placed, and preserves the integrity and aesthetics of the rock face.

SUMMARY OF THE INVENTION

The spring-loaded camming nut of the present invention is adapted to overcome the above-noted shortcomings and to fulfill the stated needs.

The spring-loaded camming nut of the invention includes first and second wedgeshaped chock portion. The first chock portion is wedge-shaped and larger than the second. The second chock portion is prism-shaped with a triangular cross-section. Means are provided for moving the first chock portion axially, lateral to the second chock portion. As the smaller second chock portion travels along the larger first chock portion, toward the crack's opening, the first chock portion rotates on its horizontal axis, causing a tooth of the second chock portion to move horizontally, and upwardly, into the rock.

It is an object of the present invention to provide apparatus able to engage, securely yet easily releasably, a crack in a solid surface.

Another object of the invention is to provide climbing anchor apparatus which is simple in construction, yet reliable in operation and not costly.

It is a further object of the present invention to provide rock climbing apparatus able to be manufactured in one or a few standard sizes, thus reducing cost per unit and the amount of gear a climber must purchase and carry.

Another object of the present invention is to provide climbing surface-engaging apparatus not prone to creep, shift in, or walk into the surface feature with which it is engaged.

Still further objects of the inventive apparatus disclosed herein will be apparent from the drawings and following detailed description thereof.

DESCRIPTION OF THE PREFERRED EMBODIMENT

Figure 1:
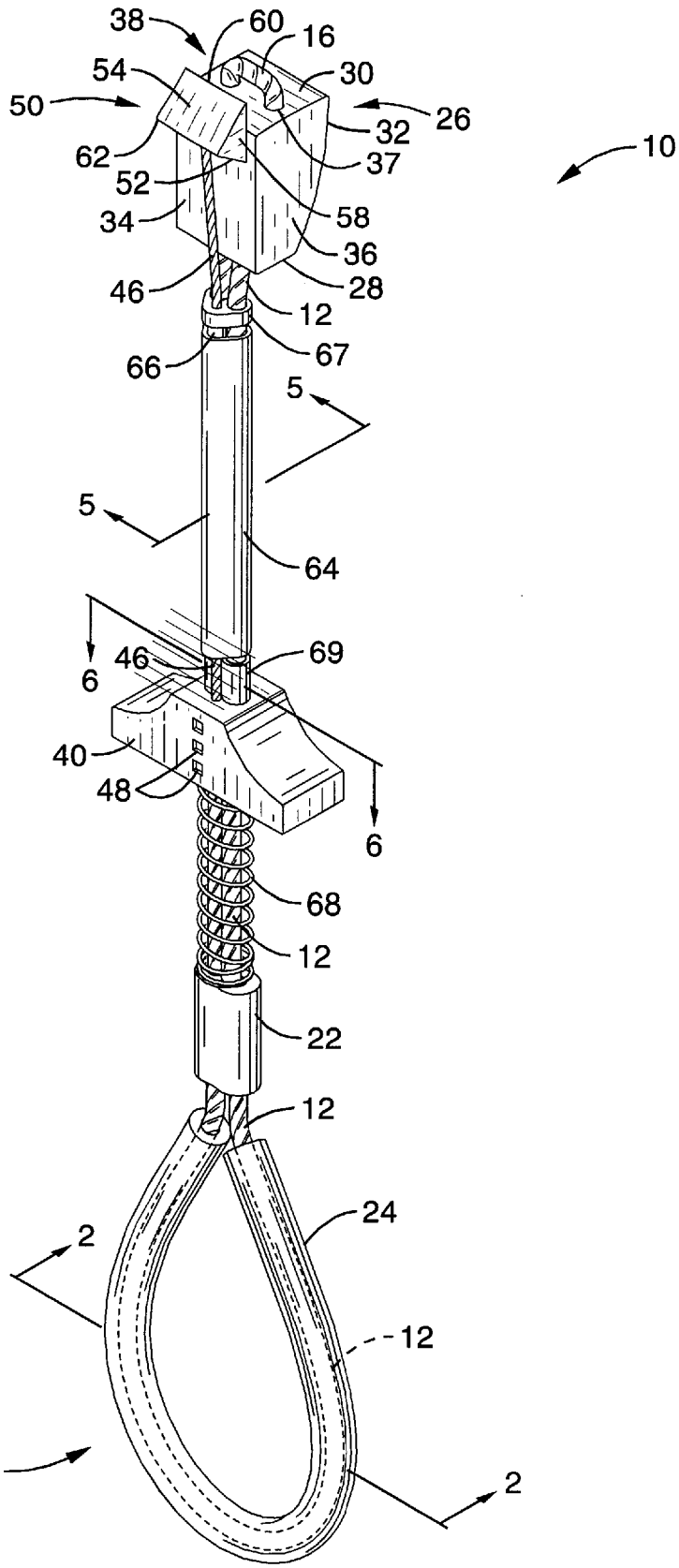
FIG. 1 is a perspective view of the spring-loaded camming nut apparatus of the invention in its starting, relaxed orientation.

Referring now specifically to the drawings, FIG. 1 shows the inventive spring-loaded camming nut apparatus, which is generally identified herein with the reference numeral 10.

The primary structural member of apparatus 10 is a flexible length of cable, anchor cable 12, which forms a terminal proximal loop 14 and a terminal distal loop 16.

For consistency in orientation herein, the directional convention established above will be continued here and in the claims. Thus, elements located nearer to that end of apparatus 10 where loop 14 is located will be referred to as proximal, as they are closer to the user. Conversely, elements located nearer to the opposing, terminal end of distal loop 16 will be referred to as distal. The same convention will be used to refer to the directional movement of elements. Thus, movements in a proximal direction will be understood to be toward loop 14 and the user, and movements referred to as distally-directed will be understood to be in the direction of loop 16's terminus, and therebeyond.

The cable stock used in anchor cable 12 is preferably comprised of multi-stranded, twisted steel. The diameter and break strength of the cable used may vary in different versions of apparatus 10, depending on the intended use. For example, in "aid climbing" where rope ladders are used to travel only four feet or less at a time, climbers risk only very short falls. Thus, for aid climbing, cables of one-quarter inch or less may be satisfactory. In contrast, for "free climbing" where much longer fall potentials exist, cables of three-eighths inch to one-half inch will be preferred.

Further, the preferred cable should have a somewhat resilient character in lengths such as are used in the construction of spring-loaded camming nut apparatus 10, such that when a length of such cable is bent or otherwise deformed, it tends to spring back to a generally linear configuration. However, other types of cable and wire rope of twisted, woven, braided or even mono-stranded construction, and of different materials, may be satisfactory in practicing the invention as long as they meet the specifications generally known in the art to be required for the intended purposes. Even solid, rigid stock may be satisfactory or preferred in some instances.

Figure 2:
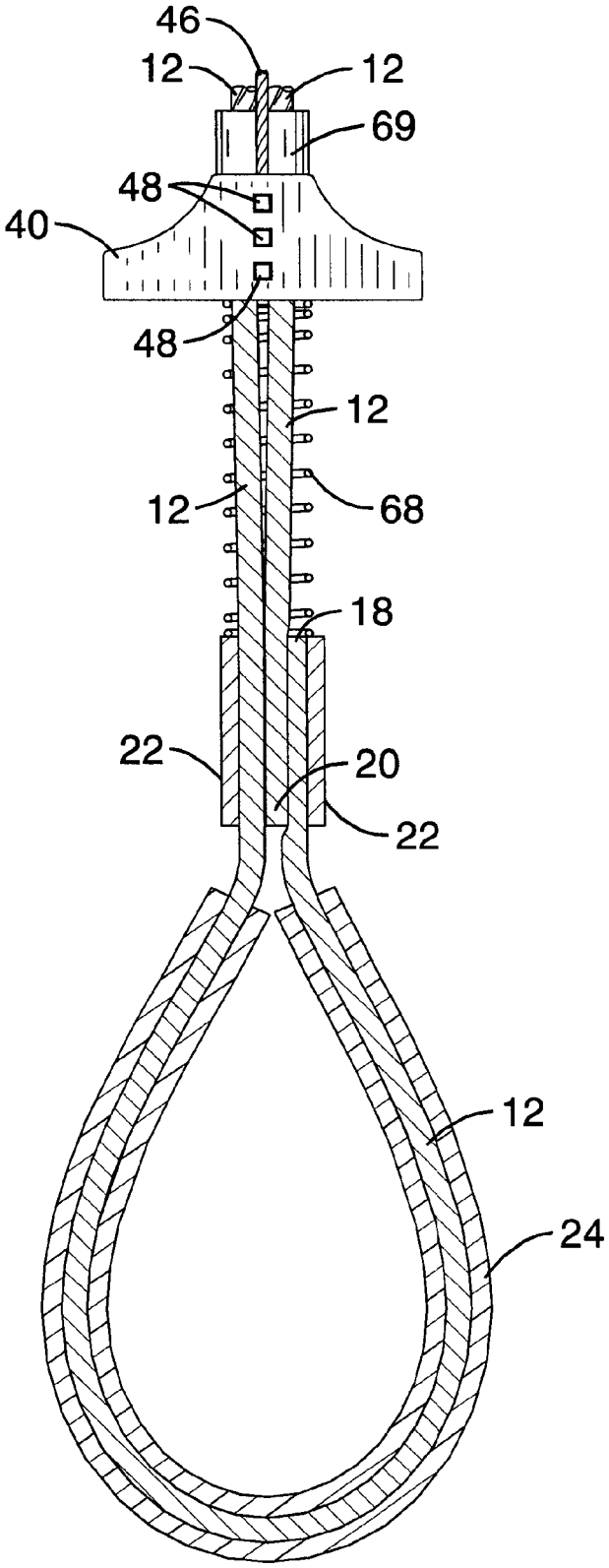
FIG. 2 is an enlarged, fragmentary cross-section of the proximal end of the apparatus of FIG taken along lines 2—2 of FIG. 1.

Anchor cable 12 is comprised of a single piece of cable with its ends 18 and 20 folded back and laid against a midportion of anchor cable 12, meeting together, such that anchor cable 12 is doubled and such that proximal loop 14 and distal loop 16 are formed. Cable ends 18 and 20 meet and overlap beneath, and are secured in place by, proximal cable clamp 22. This is best shown in FIG. 2. Proximal clamp 22 is preferably a generally cylindrical collar of deformable metal, swaged in place in any of a number of ways known in the art. However, other types of clamps employing mating portions secured with screws and other such fasteners may also suffice. In any case, once properly in place, proximal clamp 22 must be of such secure engagement as to prevent failure of loop 14 under a load at least equal to the break-strength rating of anchor cable 12.

As shown in FIG. 2, proximal loop 14 is preferably covered with a flexible, durable, smooth-surfaced sheath 24. Sheath 24 prevents damage to the strands of the cable of which loop 14 is comprised; prevents abrasion of other climbing apparatus by the cable; and protects the hands of the user from abrasion by anchor cable 12. Sheath 24 is preferably constructed of tubular flexible plastic stock. However, other constructions and materials may also work satisfactorily. Tubular rubber sleeves may be an option but, if used, would preferably include a low-friction surface. Various types of dipped plastic or rubberized coatings might also work satisfactorily.

Figure 3:
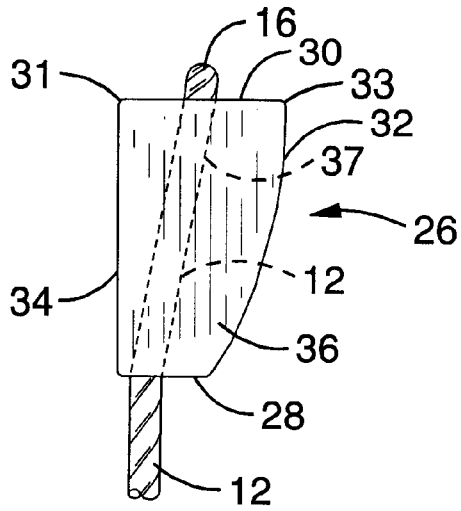
FIG. 3 is an enlarged side view of the larger, wedge-shaped chock of the apparatus.

Anchor cable 12 extends distally beyond proximal cable clamp 22, ending in distal loop 16. Distal loop 16 is fitted with wedge-shaped chock 26. This is shown in FIG. 3. Wedge-shaped chock 26's shape includes rectangular proximal end 28 face; rectangular distal end 30 face parallel to proximal face 28; convexly-curved rectangular outer face 32; planar rectangular inner face 34; and, parallel planar first and second side faces 36 and 38. Wedge-shaped chock 26 also includes two tubular apertures 37 entirely through wedge-shaped chock 26 from proximal end 28 to distal end 30, parallel to each other and to first and second side faces 36 and 38. The diameters of tubular apertures 37 are slightly larger than the diameter of anchor cable 12, such that cable 12 slides through apertures 37.

Wedge-shaped chock 26 is narrower at its proximal end and wider at its distal end, such that the rectangle of proximal end face 28 is smaller than the rectangle of distal end face 30. As may be observed in the drawing figures, the more distal end of chock 26's curved outer face 32 is generally parallel to inner face 34, while a tangent to the curve at the more proximal end of inner face 34 may be at as much as roughly a 40-degree angle, or so, to inner face 34. The degree of curvature at chock 26's proximal end may vary, depending on a user's needs, as further set forth below.

Finger pull bar 40 is a rigid length of metal stock mounted on anchor cable 12 in an orientation which is generally perpendicular to the longitudinal axis of apparatus 10. Finger pull bar 40 includes two larger apertures 42 through which the two side-by-side portions of the mid-length of doubled anchor cable 12 pass in slidingly unencumbered fashion.

Figure 4:
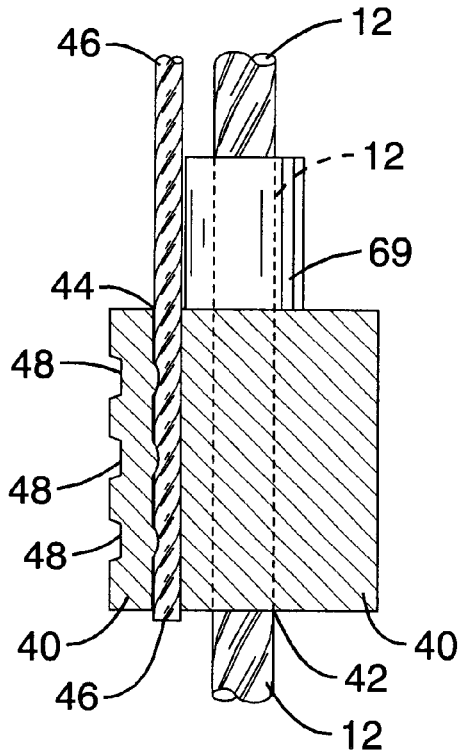
FIG. 4 is an enlarged, fragmentary cross-section through the finger pull bar of the apparatus takes on lines 5—5 of FIG. 1.

A smaller, third aperture in finger pull bar 40 is small central aperture 44, disposed adjacent to large apertures 42 in finger pull bar 40. Small central aperture 44 is equidistant from the opposed ends of finger pull bar 40. Small central aperture 44 securely receives the proximal end of release cable 46. As shown in FIG. 4, swaged indentations 48 bind the proximal end of release cable 46 into small central aperture 44, thus tying release cable 46 securely and rigidly to finger pull bar 40. Thus, as finger pull bar 40 is moved slidingly to and fro axially along anchor cable 12, release cable 46 moves axially and equivalently, parallel to anchor cable 12.

Prism-shaped chock 50 is constructed of steel and is swaged to the distal end of release cable 46. Prism-shaped chock 50 is shaped as a five-sided prism, having a generally isosceles-triangular cross-section when bisected by a plane parallel to apparatus 10's longitudinal axis. Prism-shaped chock 50 includes rectangular planar proximal face 52; rectangular planar distal face 54; rectangular planar inner face 56; and, two parallel, triangular, planar side faces 58. The juncture of prism-shaped chock 50's proximal and distal faces 52 and 54 forms a projecting edge generally referred to herein as apex 62. Apex 62 is preferably oriented transverse to the longitudinal axes of apparatus 10 and wedge-shaped chock 26.

Prism-shaped chock 50 is considerably smaller than wedge-shaped chock 26, such that, in the direction of the longitudinal axis of apparatus 10, the length of inner face 34 of wedge-shaped chock 26 is roughly two, to two and a half, times the length of prism-shaped chock 50's inner face 56. And, the width of wedge-shaped chock 26's inner face 34 is roughly one and a half times the width of inner face 56 of prism-shaped chock 50.

Prism-shaped chock 50 is disposed and oriented such that its inner face 56 is flush against, and slidable over the surface of, inner face 34 of wedge-shaped chock 26.

Figure 5:
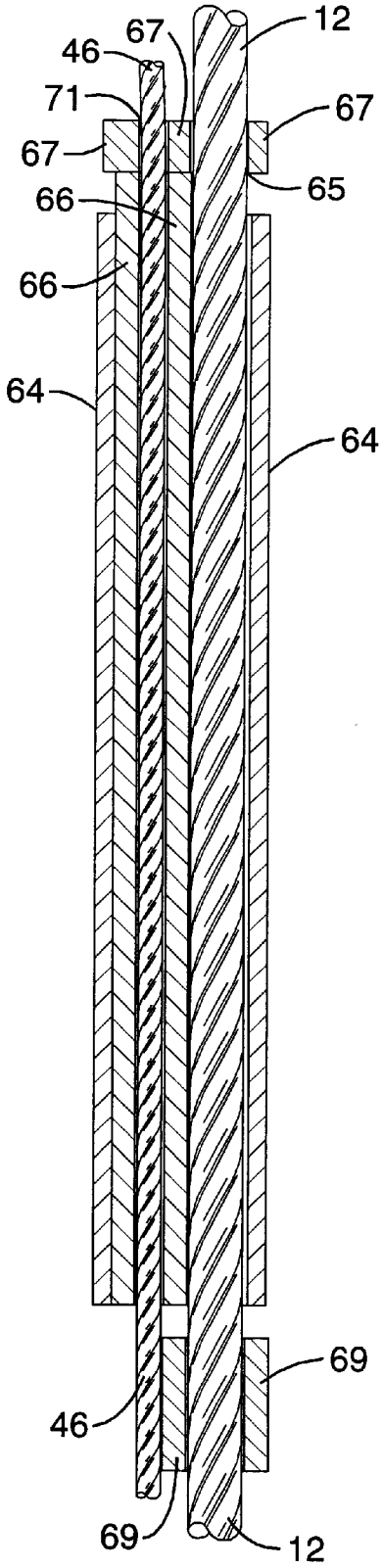
FIG. 5 is an enlarged, fragmentary cross-section through the mid-length of the cables and sheaths the apparatus taken on lines 5—5 of FIG. 1.

As shown in FIG. 5, large diameter sheath 64 wraps around and covers most of double anchor cable 12 between finger pull bar 40 and wedge-shaped chock 26. Large diameter sheath 64 is generally cylindrical and is preferably constructed of durable, flexible plastic. Large diameter sheath 64 is dimensioned to hug doubled anchor cable 12 securely. The cross-section of large diameter sheath 64 is not precisely circular because, in addition to surrounding doubled anchor cable 12, large diameter sheath 64 also surrounds and hugs small diameter sheath 66, through which release cable 46 passes.

Large diameter sheath 64 and small diameter sheath 66 are disposed parallel to each other. Small diameter sheath 66 is slightly longer than large diameter sheath 64. Small diameter sheath 66 is preferably constructed of durable, flexible plastic and has an inside diameter slightly larger than the diameter of release cable 46. Small diameter sheath 66 has a circular cross-section throughout its length. Release cable 46 is able to pass freely and slidingly to and fro through small diameter sheath 66. Both large diameter sheath 64 and small diameter sheath 66 are fixed in place in relation to one another and in relation to anchor cable 12. Anchor cable 12 neither slides with respect to large diameter sheath 64, nor with respect to small diameter sheath 66. As release cable 46 passes to and fro through small diameter sheath 66, anchor cable 12, large diameter sheath 64, and small diameter sheath 66 retain their positions. This is best achieved by constructing large diameter sheath 64 of a material which can be shrunk around anchor cable 12 and small diameter sheath 66, thus binding them tightly to one another. Such tubular, heat-shrink material is well-known in the art.

Between the distal end of large diameter sheath 64 and wedge-shaped chock 26, doubled anchor cable 12 and release cable 46 are held in position with respect to each other by cable guide 67. As will be understood by comparing FIGS. 1 and 5, cable guide 67 is planar and triangular in shape, and disposed perpendicularly to cables 12 and 46.

Cable guide 67 includes three cylindrical apertures. Each portion of doubled anchor cable 12 passes separately through one of two larger apertures 65 of guide 67, and each is securely bound against any to-and-fro movement therethrough by a tight-fitting relationship between the diameters of apertures 65 and the diameters of each respective portion of doubled anchor cable 12. Smaller aperture 71 has a diameter slightly greater than release cable 46's diameter, and lets cable 46 slide freely therethrough.

Figure 6:
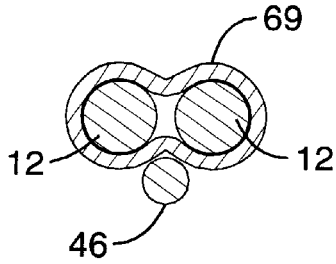
FIG. 6 a cross-sectional view of the distal cable clamp taken on lines 6—6 of FIG. 1.

Between the proximal end of large diameter sheath 64 and finger pull bar 40, doubled anchor cable members 12 are held together by swaged distal cable clamp 69. As shown in FIG. 6, release cable 46 lies outside distal clamp 69.

Finger pull bar 40 and prism-shaped chock 50 are operatively connected through release cable 46 such that moving finger pull bar 40 to and fro axially slides release cable 46 through small diameter sheath 66, and moves prism-shaped chock 50 to and fro axially and, simultaneously, laterally past wedge-shaped chock 26.

Coil spring 68 is disposed coaxially upon the more proximal portion of doubled anchor cable 12, between the distal end of proximal cable clamp 22 and the proximal face of finger pull bar 40. Finger pull bar 40 is biased toward its most distal position by coil spring 68. Thus, as finger pull bar 40 is operatively connected to prism-shaped chock 50, prism-shaped chock 50 is also biased toward its most distal position by coil spring 68.

Figure 7:
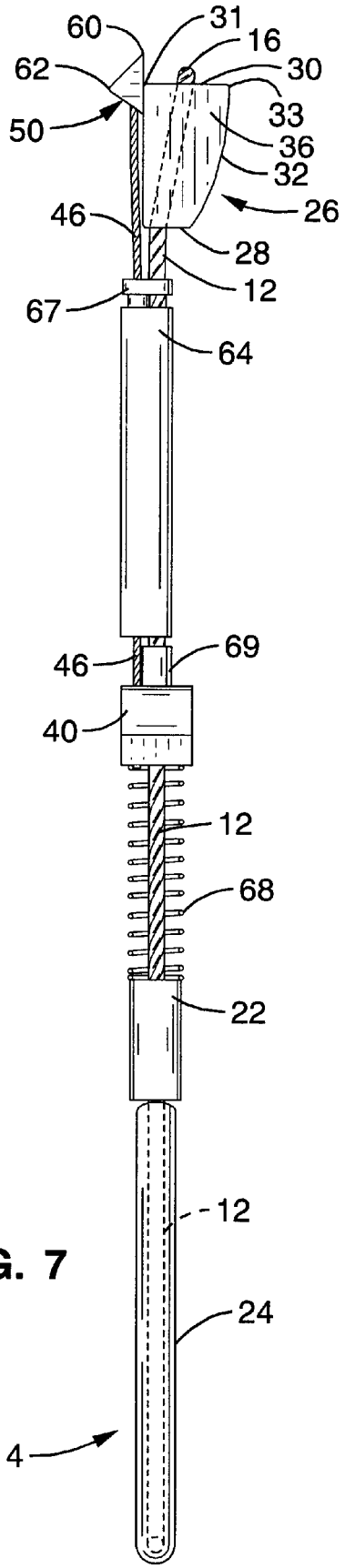
FIG. 7 is a side elevation showing the apparatus in its fully relaxed posture, as in FIG. 1.

The length of release cable 46 is preferably such that when coil spring 68 is fully extended and uncompressed, about half the longitudinal length of prism-shaped chock 50's inner face 56 projects beyond the distal extent of wedge-shaped chock 26's inner face 34. That is, apex 62 resides in approximately the same plane as distal end face 20 of wedge-shaped chock 26. The portions of wedge-shaped chock 26's inner face 34 and prism-shaped chock 50's inner face 56 which are in contact with one another should be flush, face-to-face. This relationship of the relaxed, starting-position relationship of wedge-shaped chock 26 and prism-shaped chock 50 is best shown in FIGS. 1 and 7. Drawing finger pull bar 40 in a proximal direction, thus compressing coil spring 68, should cause prism-shaped chock 50's,inner face 56 to slide smoothly and distally over a wedged shaped chock 26 inner face 34. Smooth, face-to-face contact of chocks 26 and 50 is assured if release cable 46 has a preferred resilient, linear shape-retaining character, tending to bias prism-shaped chock 50 against wedge-shaped chock 26. Drawing finger pull bar 40 to its most proximal extent preferably causes prism-shaped chock 50's apex 62 to reside proximally somewhat beyond wedge-shaped chock 26's proximal end face 28. The portions of wedge-shaped chock 26's inner face 34 and prism-shaped chock 50's inner face 56 which are in contact with one another at this proximal extreme of prism-shaped chock 50 should, again, remain flush and face-to-face.

Figure 8:
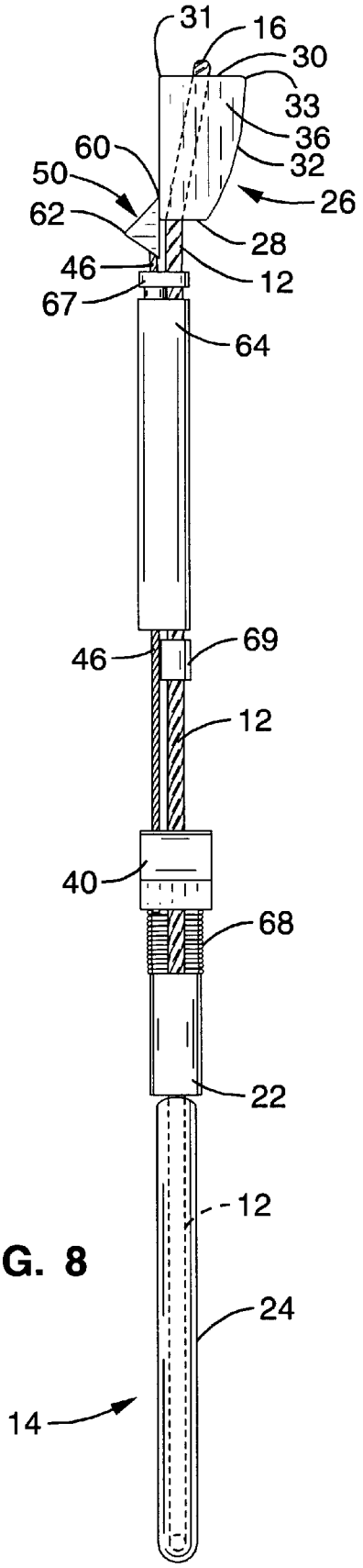
FIG. 8 is a side elevation showing the apparatus with its prism-shaped chock and finger pull bar in their fully-retracted postures.
Figure 9:
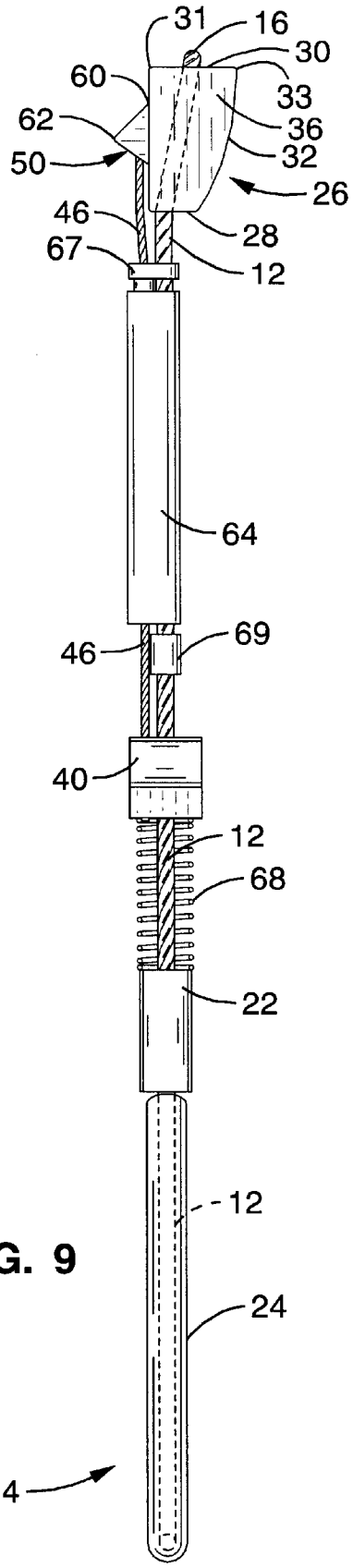
FIG. 9 is a side elevation showing the apparatus with its prism-shaped chock and finger pull bar at roughly the mid-point in their respective paths of travel, as they might be when the apparatus is engaged with a crack in a rock.

In use, the dimensions of wedge-shaped chock 26 and prism-shaped chock 50 with respect to the intended crack in which they will be used should be as follows. When spring-loaded camming nut apparatus 10 is in the relaxed position, i.e. when coil spring 68 is fully extended and uncompressed as shown in FIGS. 1 and 7, the midpoint of inner face 56 of prism-shaped chock 50 is disposed adjacent to inner edge 31 of distal end face 30 of wedge-shaped chock 26. Thus, the width of wedge-shaped chock 26, at its maximum, combined with the width of prism-shaped chock 50 at its maximum should be greater than the crack's width. Conversely, as finger pull bar 40 is drawn in a proximal direction to the point where forward edge 60 of prism-shaped chock 50 lies nearly laterally adjacent to proximal end 28 of wedge-shaped chock 26, as shown in FIG. 8, the width of wedge-shaped chock 26 combined with the width of the adjacent portion of prism-shaped chock 50 should be slightly less than the intended crack's width. Thus, somewhere in the mid-portion of prism-shaped chock 50's travel along inner face 34 of wedge-shaped chock 26, the combined width of wedge-shaped chock 26 at that point, combined with the width of prism-shaped chock 50 from inner face 56 to apex 62, should equal the intended crack's width. This is best illustrated by reference to FIG. 9, which shows apparatus 10 with prism-shaped chock 50 in a partially-retracted position.

Figure 10:
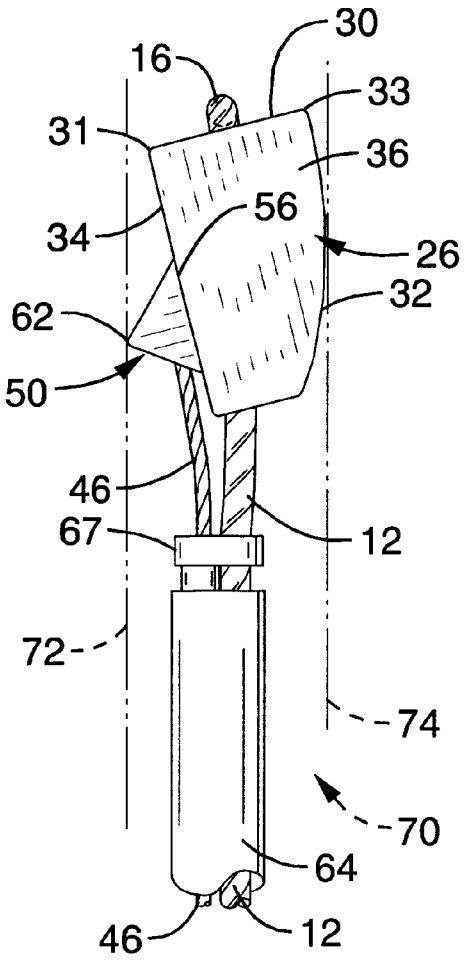
FIG. 10 is an enlarged side elevation showing the apparatus in its ready position in a crack, before being set.

For secure engagement of apparatus 10 in a crack, for example generally vertical crack 70 having parallel left and right walls, 72 and 74, a starting orientation and posture substantially as shown in FIG. 10 is preferred. To achieve the starting posture shown in FIG. 10, the user first grasps proximal loop 14 in hand, and with two fingers pulls proximally on finger pull bar 40, compressing coil spring 68, and causing prism-shaped chock 50's inner face 56 to slide proximally past wedge-shaped chock 26's inner face 34. While holding prism-shaped chock 50 in this retracted position, the user then drives apparatus 10's distal end into crack 70. As doubled anchor cable 12 is rather stiff, it is fairly easy to direct apparatus 10's chocks as deep as necessary into crack 70, or into the best position within reach for achieving a secure engagement. At some point in apparatus 10's travel into the crack, even if its distal end is not visible, if fair resistance is felt, this indicates to the user that apparatus 10 is likely in a spot in crack 70 having a width within the range of that particular-sized apparatus 10's usefulness. In feeling out a crack, apparatus 10's finger pull bar 40 may also be worked to and fro a bit, to test for the best spot. Alternatively, in situations where the user can view apparatus 10's distal end while making the insertion, as in surface cracks, a point in the crack having the optimum width may be visually chosen.

In the insertion process, the relative positions and actions of chocks 26 and 50 are preferably as follows. Prism-shaped chock 50's apex 62 ideally catches on left wall 72; wedge-shaped chock 26's convex-curved outer face 32 slides distally against crack 70's right wall 74; chock 26, sliding distally a bit with respect to prism-shaped chock 50 and pivoting slightly, rotates a short distance counter-clockwise on an axis transverse to apparatus 10's length, such that distal end face 30 tilts toward crack 70's left wall 72 beyond prism-shaped chock 50; and, inner edge 31 of distal end face 30 approaches left wall 72. Wedge-shaped chock 26's action of sliding a bit distally with respect to prism-shaped chock 50 is the result of a kind of rocking motion wherein apex 62 of chock 50 acts as a fulcrum. At this point, the portions of anchor cable 12 and release cable 46 between cable guide 67 and their respective chocks are preferably bent slightly toward left wall 72. Thus, this is the ready position illustrated in FIG. 10.

The shape of the more proximal portion of wedge-shaped chock 26's convexly-curved outer face 32 is critical to achieving the optimal ready position shown in FIG. 10, and to the function of apparatus 10. This proximal end of curved face 32 allows wedge-shaped chock 26 to tilt optimally beyond prism-shaped chock 50 in the crack. And, due to the shape of smoothly curved face 32, this tilting is able to proceed as a smoothly tilting arc, without any sharp stops or starts as might occur if a more block-shaped wedge having a sharp-angled trailing corner were employed. This smooth shape of wedge-shaped chock 26 at its narrower, proximal end allows apparatus 1 significantly smaller than would be possible with an equivalent device having a substantially planar outer face.

Once placed at the ready as in FIG. 10, the user then fully releases finger pull bar 10. Prism-shaped chock 50's tendency toward return travel in the distal direction driven by coil spring 68 causes chock 50's apex 62 to bear with a slight bit more force against left wall 72, and causes wedge-shaped chock 26's curved outer face 32 to bear against right wall 74 with equally additional force. It may also be preferable at this point for the user to direct a bit of additional force in an axial direction along doubled anchor cable 12, just to make sure chocks 26 and 50 are in an optimal position for the camming action to follow.

Figure 11:
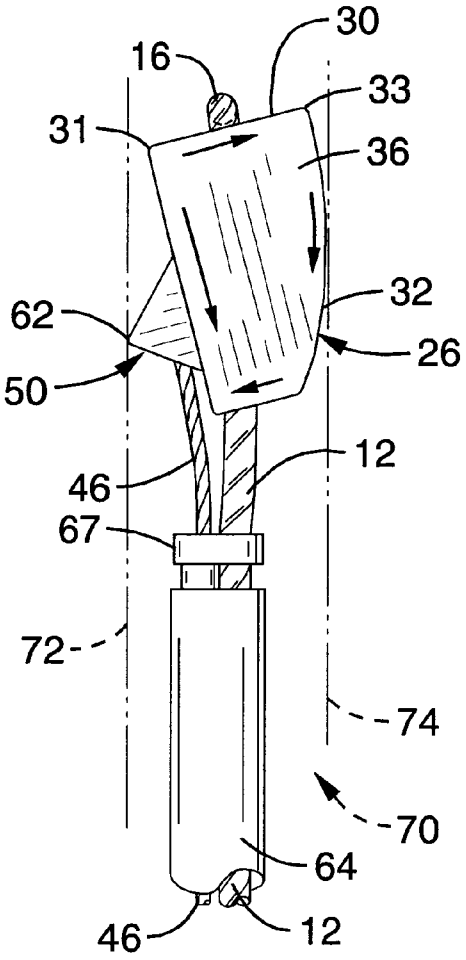
FIG. 11 is an enlarged side elevation similar to that of FIG. 10 with added directional arrows to illustrate the action which results in the final, set position of the apparatus in a crack.
Figure 12:
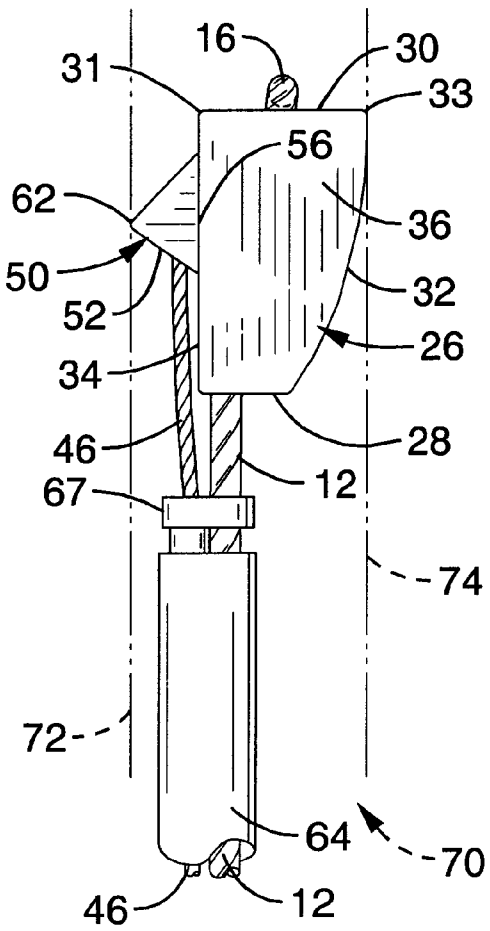
FIG. 12 is an enlarged side elevation showing the apparatus in its final set position in a crack.

The user then tugs proximally on anchor cable 12's proximal loop 14. This causes wedge-shaped chock 26 to rotate clockwise on its transverse axis, pivoting around the fulcrum formed at the point where apex 62 meets left wall 72, such that chock 26's distal end face 30 tilts back toward a perpendicular position with respect to apparatus 10's longitudinal axis, and outer edge 33 of distal end face 30 contacts right wall 74. This further causes wedge-shaped chock 26 to move slightly in a proximal direction, while prism-shaped chock 50 stays in place, but pivots slightly around apex 62. Anchor cable 12 straightens out in this process. These movements are summed up in FIG. 11, which includes directional arrows on a figure like FIG. 10 to illustrate the action which results in apparatus 10's final, set position illustrated in FIG. 12.

This rotation and proximal movement of wedge-shaped chock 26 causes prism-shaped chock 50's apex 62 to bear with greatly increased force against its point of contact with left wall 72. Although equal force is exerted by wedge-shaped chock 26 against right wall 74, the surface area over which apex 62 contacts the crack is so small, that apex 62 acts as a tooth which bites sharply into left wall 72. The heavier the load on anchor cable 12, the more secure apex 62's bite. Thus, apex 62's secure engagement with the crack wall is a great deterrent to apparatus 10 slipping distally out of crack 70.

As in the insertion process, convexly-curved face 32 aids greatly in the process of setting apparatus 10 into its final, secure position. Wedge-shaped chock 26's clockwise rotation and slight proximal travel upon loading results in a smooth, highly-effective camming action, driving apex 62 very forcefully into left wall 72. This action is similar to that observed in operation of the devices known in the art as Tri-cams, known for their ability to lodge well in parallel-walled cracks. However, apparatus 10 is not nearly as difficult as a Tri-cam to place properly, nor is it as easy to dislodge accidently. Further, the smoothly-curved shape of wedge-shaped chock 26's outer face 32 from being parallel to inner face 34 at chock 26's distal end, to being a substantially angled curve at chock 26's proximal end, permits a unique, combined mechanical action to take place. First, as wedge-shaped chock 26 slides proximally between prism-shaped chock 50 and right wall 74, apex 62 is driven into left wall 72 with greater laterally directed force. This is essentially what would be observed if chock 26 were merely a straight-sided, conventional wedge. However, as wedge-shaped chock 26 rotates on an axis transverse to apparatus 10's length, and curved outer face 32 rolls such that its point of contact with right wall 74 moves distally, this separate but simultaneous action also drives apex 62 into left wall 72.

Once a user loads apparatus 10 in the course of rock climbing or some other endeavor, forces may be placed on the apparatus which are not directly in line with its longitudinal axis. For example, proximal loop 14 may be pulled in slightly lateral direction when used as a pulley for hauling up gear. In such cases, the emplacement of apparatus 10 is likely to stay secure owing to that feature of apparatus 10's construction which allows inner faces 34 and 56 of chocks 26 and 50 to slide smoothly with respect to one another. Such lateral stresses transferred through anchor cable 12 will tend to cause wedge-shaped chock 26 to shift side-to-side a bit between prism-shaped chock 50 and right wall 74, but prism-shaped chock should remain in place.

Removal of spring-loaded camming nut apparatus 10 is simple and can be accomplished in several ways, as will be understood by those familiar with the use of such devices. In most cases, finger pull bar 40 is drawn proximally against the bias of coil spring 68, while pushing proximal loop 14 and thus wedge-shaped chock 26 slightly distally. This reduces the combined effective width of wedge-shaped chock 26 and prism-shaped chock 50, such that apparatus 10 may be withdrawn from the crack. Slight rotation of apparatus 10 about its longitudinal axis may aid its withdrawal from the crack.

When apparatus 10 is more securely set or welded in place after bearing a heavy load, a second method for removal may be more appropriate. A thin, elongate punch, pick, file, probe, or other long, narrow, rigid member is simply inserted into the crack beside anchor cable 12 and set firmly against proximal end 28 of wedge-shaped chock 26. Then, just a light distally-directed tap on the rigid member will drive wedge-shaped chock 26 distally and out of engagement with the wall of the crack and inner face 56 of prism-shaped chock 50. Once dislodged, finger pull bar 40 is drawn proximally, and apparatus 10 is removed from the crack.

Yet a third alternative approach to dislodging apparatus 10 from a crack is to give a quick jerk or tap on finger pull bar 40 in a proximal direction.

It should be noted that it is important to the proper operation of apparatus 10 for release cable 46 to be resilient, yet shape-retaining, such that it tends to spring back toward a linear posture after being deformed. This property tends to keep prism-shaped chock 50 close against inner face 34 of wedge-shaped chock 26 as prism-shaped chock 50 moves to and fro laterally past wedge-shaped chock 26. This is best illustrated by a comparison of FIGS. 7, 8 and 9. When coil spring 68 is fully extended and uncompressed, and finger pull bar 40 is in its distal-most position as shown in FIG. 7, wedge-shaped chock 26's distal end 30 rests adjacent the midpoint of prism-shaped chock 50's inner face 56. In this posture, release cable 46 is bent slightly radially away from its own longitudinal axis, and away from the longitudinal axis of distally-projecting anchor cable 12. However, the resilient, shape-retaining character of release cable 46 tends to bias prism-shaped chock 50 against inner face 34 of wedge-shaped chock 26, with some force. It should also be remembered that in this posture, the width, i.e. the thickness, of wedge-shaped chock 26, at its maximum, and the thickness of prism-shaped chock 50, at its maximum, when the two are lateral to each other, is greater than the width of the crack. Thus, in this posture, the combined effective width of apparatus 10's chocks is too great to permit apparatus 10 to be inserted into the crack for which apparatus 10 is designed. But, chocks 26 and 50 are held close together by release cable 46.

Then, as finger pull bar 40 is drawn in the proximal direction to the point where forward edge 60 of prism-shaped chock 50 lies laterally adjacent to proximal end 28 of wedge-shaped chock 26, the tendency of release cable 46 to return to a linear posture keeps forward edge 60 close to wedge-shaped chock 26. This is shown in FIG. 8. With prism-shaped chock 50 drawn proximally as shown, the combined width of chocks 26 and 50 at apparatus 10's distal end should become slightly less than the intended crack's width. And, with release cable 46 holding prism-shaped chock 50 flush against wedge-shaped chock 26, the distal end of apparatus 10 is easily inserted into the opening of crack 70 and driven deep into its interior. This requires only one hand of the user. As long as finger pull bar 40 is drawn proximally, apparatus 10 may be driven distally into crack 70 without obstruction. Then, once finger pull bar 40 is released and proximal loop 14 is tugged in a proximal direction, prism-shaped chock 50 and release cable 46 are again deflected radially away from wedge-shaped chock 26 and distally-projecting anchor cable 12.

The shape-retaining tendency of release cable 46 to seek a linear posture also comes into play in removal of apparatus 10 from crack 70. Once wedge-shaped chock 26 is tapped slightly in a distal direction or prism-shaped chock 50 is jerked proximally, thus terminating wedge-shaped chock 26's camming action, drawing finger pull bar 40 proximally draws prism-shaped chock 50 proximally and, at the same time, causes release cable 46 to draw prism-shaped chock 50 radially inward due to release cable 46's tendency to return to a linear posture. This permits proximal face 52 of prism-shaped chock 50 to nest-in close to proximal end 28 of wedge-shaped chock 26, as in FIG. 8. Prism-shaped chock 50 is thus retained in that position while apparatus 10 is withdrawn from crack 70. This retention of prism-shaped chock 50 in a radially inward position reduces the likelihood that prism-shaped chock 50's tooth 62 will catch on the surface of crack 70 as apparatus 10 is withdrawn therefrom.

The amount of force with which prism-shaped chock 50 bears against inner face 34 of wedge-shaped chock 26 is adjustable in the construction of apparatus 10 by varying the lengths of cables 46 and 12 between cable guide 67 and chocks 50 and 26. If cable guide 67 is close to chocks 50 and 26, then prism-shaped chock 50 will bear strongly against wedge-shaped chock 26. Cables projecting a greater distance beyond cable guide 67 will bias chock 50 against chock 26 with less force. The thickness and resilience of the cable stock used in constructing release cable 46 may also be chosen to achieve the desired amount of force of prism-shaped chock 50 against wedge-shaped chock 26.

Figure 13:
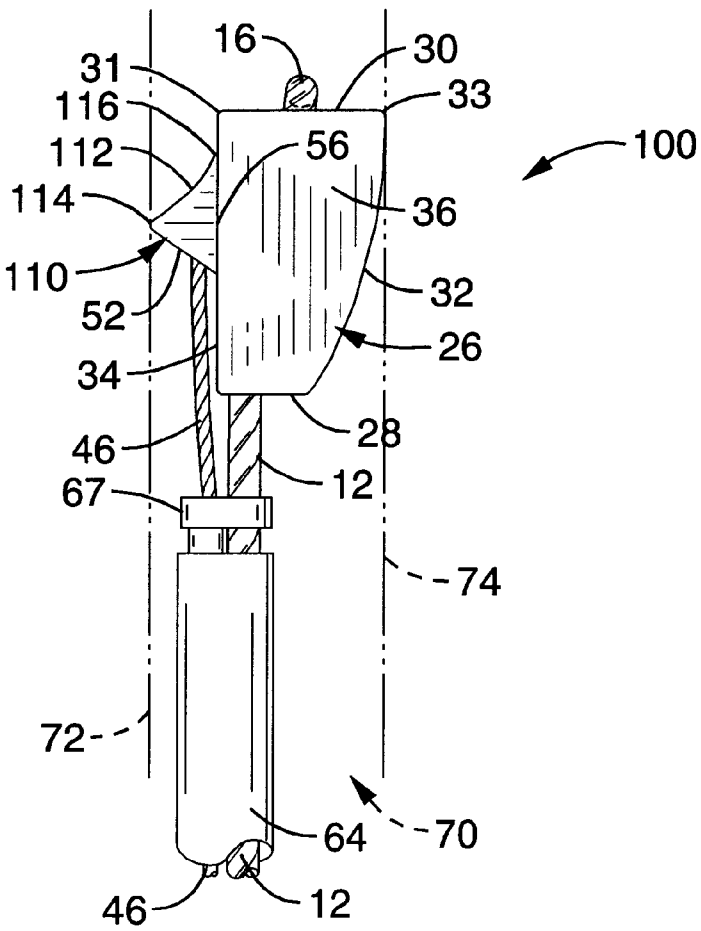
FIG. 13 is an enlarged side elevation showing an alternative embodiment of the apparatus, having a wedged shaped chock with a concavely-curved distal face, in its final set position in a crack.

A second embodiment of the inventive apparatus is shown in FIG. 13, that embodiment being generally identified with reference numeral 100. Apparatus 100 generally includes a modified prism-shaped chock 110. Chock 110's features are essentially identical to prism-shaped chock 50, except that chock 110 includes a distal face 112 having a concavely-curved surface. The curve of distal face 112 describes a portion of a roughly cylindrically-arced plane around an axis transverse to apparatus 100's length, and parallel to chock 110's inner face 56. Concave distal face 112's shape results in a slightly differently-shaped apex 114. Apex 114 sweeps slightly distally. Chock 110's distal edge 116 also has a slightly altered shape in comparison with that of the first embodiment. Concave distal face 112's shape causes distal edge 116 to be thinner, and more knife-like.

Several advantages derive from alternative chock 110's structure. One is that apparatus 100 may be able to travel a little farther into some cracks, as concave face 112 provides a bit more clearance from obstructions. Another is that apex 114 acts a bit more like a claw, directing its force in a slightly distal direction into, for example, left wall 72, in contrast to prism-shaped chock 50 through which force is directed essentially laterally. This aspect of apex 114's shape may also provide apparatus 100 with a bit more tenacious grip in difficult places, such as in cracks that flare out in a proximal direction. And, chock 110's thin distal edge 116 is perhaps a bit better able to scrape and clear away any obstructing debris from wedge-shaped chock 26's inner face 34.

It should be understood that prism-shaped chocks of somewhat altered configurations are considered to be within the scope of the invention. That is, although the prism-shaped chocks herein have essentially isosceles triangular cross-sections, prismatic shapes with other cross-sections may also work satisfactorily. For example, the generally rectangular proximal and distal faces 52 and 54 of a prism-shaped chock may be of different sizes, such that one of those faces is closer to being perpendicular to apparatus 10's longitudinal axis. Or, a prism-shaped chock may include side faces 50 which are non-parallel, thus possibly increasing or greatly decreasing the apex's effective length. Generally, a wider apex will spread force over a longer line of contact with the side wall, while a narrower apex will concentrate force over a shorter line of contact. Longer or shorter apex lines may be chosen for specific purposes. Further, many types of chocks shaped differently from prism-shaped chock 50, but having a laterally-projecting apex able to function similarly to provide a transversely-oriented fulcrum, are also envisioned. For example, a chock having a generally circular inner face from which an apex projects laterally would still be within the spirit of the invention.

It should be further understood that the degree of curvature of wedge-shaped chock 26's curved outer face 32 may vary greatly, depending on a user's needs. For example, for softer, crumbly or more-compressible rock compositions, outer face 32 may be steeply curved, so that a tangent to the curve near the proximal end of outer face 32 may approach 80 degrees, or so, with respect to chock 26's opposed inner face 34. Such steep curvature would result in a great amount of rotation in the wedge-shaped chock as it sets, and thus a great deal of camming action. And, apex 62 would be driven a great distance into the lateral rock wall in this case, as well. However, such a wedge would also apply considerable distally-directed force on prism-shaped wedge 50 before setting, thus making prism-shaped wedge 50 likely to slip distally if the crack is comprised of hard rock. Thus, for hard rock, an outer face 32 having only a shallow curve, say 10 to 20 degrees, or so, at a tangent to the curve at outer face 32's proximal end, might be desired. In this instance, the camming action is minimized, as is the distance of lateral travel of apex 62 into the crack's wall, while the wedging action is maximized by allowing wedge-shaped chock to slide distally between prism-shaped chock 50 and right wall 74. Users may have yet other criteria upon which to base the choice of the shape of convexly-curved outer face 32. However, it is envisioned that curves ranging from as little as 5 degrees divergent from the plane of inner face 34, to as much as 80 degrees, or so, may have certain usefulness.

It is yet also contemplated that, for some purposes, curves having other than smoothly-increasing angles between wedge-shaped chock 26's distal and proximal ends may be desired. Such curves may result in humps or flat spots in the camming action of the apparatus, having certain utility for particular purposes.

Accordingly, the foregoing detailed disclosure of the inventive spring-loaded camming nut apparatus 10 is considered as only illustrative of the preferred embodiment of, and not a limitation upon the scope of, the invention. Those skilled in the art will envision many other possible variations of the structure disclosed herein that nevertheless fall within the scope of the following claims.

And, alternative uses for this inventive apparatus may later be realized. For example, the apparatus may be used for engaging other solid surfaces besides rock. Accordingly, the scope of the invention should be determined with reference to the appended claims, and not by the examples which have herein been given.

We claim:

1. Apparatus for engaging a crack in a solid surface, comprising:

a. a generally wedge-shaped first chock portion, including a wider end and a narrower end;

b. a generally planar inner face between said wedge-shaped chock portion's wider end and narrower end;

c. a convexly-curved outer face between said wedge-shaped chock portion's wider end and narrower end, said outer face projecting in a direction opposed from said inner face;

d. a second chock portion, having a generally planar inner face and an apex projecting in a direction opposed from said planar inner face; and, e. means for causing said planar inner face of said second chock portion to lie flush against said planar inner face of said first chock portion.

2. The apparatus of claim 1, further including means for suspending a load from said narrower end of said first chock portion.

3. The apparatus of claim 2, wherein said load suspending means comprises a cable.

4. The apparatus of claim 2, wherein said load suspending means includes a terminal, proximal loop.

5. The apparatus of claim 1, further including means for moving said second chock portion axially, lateral to said first chock portion.

6. The apparatus of claim 5, wherein said second chock portion moving means is affixed to said second chock portion's proximal face.

7. The apparatus of claim 1, further including means for moving said first chock portion axially, lateral to said second chock portion.

8. The apparatus of claim 7, wherein said first chock portion moving means is affixed to said first chock portion's narrower end.

9. The apparatus of claim 1, wherein said second chock portion includes a proximal face and a distal face.

10. The apparatus of claim 9, wherein said second chock portion's distal face is planar.

11. The apparatus of claim 9, wherein said second chock portion's distal face is concave.

12. The apparatus of claim 1, wherein said second chock portion's apex is comprised of a projecting edge oriented transverse to a longitudinal axis of said first chock portion.

13. The apparatus of claim 1, wherein said first chock portion's wider end and said narrower end are generally parallel.

14. The apparatus of claim 1, wherein said first chock portion includes first and second parallel side faces.

15. The apparatus of claim 1, wherein said convexly-curved outer face of said first chock portion is generally parallel to said first chock portion's planar inner face at said wider end, and wherein a tangent to said convexly-curved outer face at said narrower end is angled at least 5 degrees away from said first chock portion's planar inner face.

16. The apparatus of claim 1, wherein said convexly-curved outer face of said first chock portion is generally parallel to said first chock portion's planar inner face at said wider end, and wherein a tangent to said convexly-curved outer face at said narrower end is angled at approximately 40 degrees away from said first chock portion's planar inner face.

17. The apparatus of claim 1, wherein said convexly-curved outer face of said first chock portion is generally parallel to said first chock portion's planar inner face at said wider end, and wherein a tangent to said convexly-curved outer face at said narrower end is angled at less than 80 degrees away from said first chock portion's planar inner face.

18. Apparatus for engaging a crack in a solid surface, comprising:

a. a generally wedge-shaped first chock portion, including a wider end and a narrower end;

b. a generally planar inner face between said wedge-shaped chock portion's wider end and narrower end;

c. a convexly-curved outer face between said wedge-shaped chock portion's wider end and narrower end, said outer face projecting in a direction opposed from said inner face;

d. a second chock portion, having a generally planar inner face and an apex projecting in a direction opposed from said planar inner face;

e. means for causing said planar inner face of said second chock portion to lie flush against said planar inner face of said first chock portion;

f. means for moving said second chock portion axially, lateral to said first chock portion; and, g. means for suspending a load from said narrower end of said first chock portion.

19. The apparatus of claim 1, wherein said second chock portion's apex is comprised of a projecting edge oriented transverse to a longitudinal axis of said first chock portion.

20. Apparatus for engaging a crack in a solid surface, comprising:

a. a generally wedge-shaped first chock portion, including a wider end and a narrower end;

b. a generally planar inner face between said wedge-shaped chock portion's wider end and narrower end;

c. a convexly-curved outer face between said wedge-shaped chock portion's wider end and narrower end, said outer face projecting in a direction opposed from said inner face, wherein said convexly-curved outer face of said first chock portion is generally parallel to said first chock portion's planar inner face at said wider end, and wherein a tangent to said convexly-curved outer face at said narrower end is angled at approximately 40 degrees away from said first chock portion's planar inner face;

d. a second chock portion, having a generally planar inner face and an apex projecting in a direction opposed from said planar inner face; and, e. means for causing said planar inner face of said second chock portion to lie flush against said planar inner face of said first chock portion.

* * * * *